US005347194A

United States Patent [19]

Derks

[11] Patent Number: 5,347,194

[45] Date of Patent: Sep. 13, 1994

[54] OXIDE CATHODE WITH RARE EARTH ADDITION

[75] Inventor: Petrus J. A. M. Derks, Eindhoven, Netherlands

[73] Assignee: U.S. Philips Corporation, New York, N.Y.

[21] Appl. No.: 51,255

[22] Filed: Apr. 21, 1993

Related U.S. Application Data

[63] Continuation of Ser. No. 781,541, Oct. 22, 1991, abandoned.

[30] Foreign Application Priority Data

Oct. 22, 1990 [NL] Netherlands ..... 9002291

[51] Int. Cl.[5] ..... H01J 19/06

[52] U.S. Cl. ..... 313/346 R; 313/346 DC

[58] Field of Search ..... 313/346 R, 346 DC, 270, 313/337

[56] References Cited

U.S. PATENT DOCUMENTS

| | | | |
|---|---|---|---|
| 4,359,489 | 11/1982 | Corneille | 427/77 X |
| 4,411,827 | 10/1983 | Corneille | 427/77 X |
| 4,797,593 | 1/1989 | Saito et al. | 313/355 X |
| 4,855,637 | 8/1989 | Watanabe et al. | 313/346 R |
| 5,072,149 | 12/1991 | Lee et al. | 313/346 R |
| 5,075,589 | 12/1991 | Derks et al. | 313/346 R |

FOREIGN PATENT DOCUMENTS

| | | |
|---|---|---|
| 0210805 | 2/1987 | European Pat. Off. . |
| 0012758 | 2/1974 | Japan . |
| 0005661 | 2/1980 | Japan . |

*Primary Examiner*—Donald J. Yusko
*Assistant Examiner*—Ashok Patel
*Attorney, Agent, or Firm*—Norman N. Spain

[57] ABSTRACT

The initial emission and the lifetime of oxide cathodes are considerably improved by adding small quantities of rare earth metals (10–500 ppm).

18 Claims, 1 Drawing Sheet

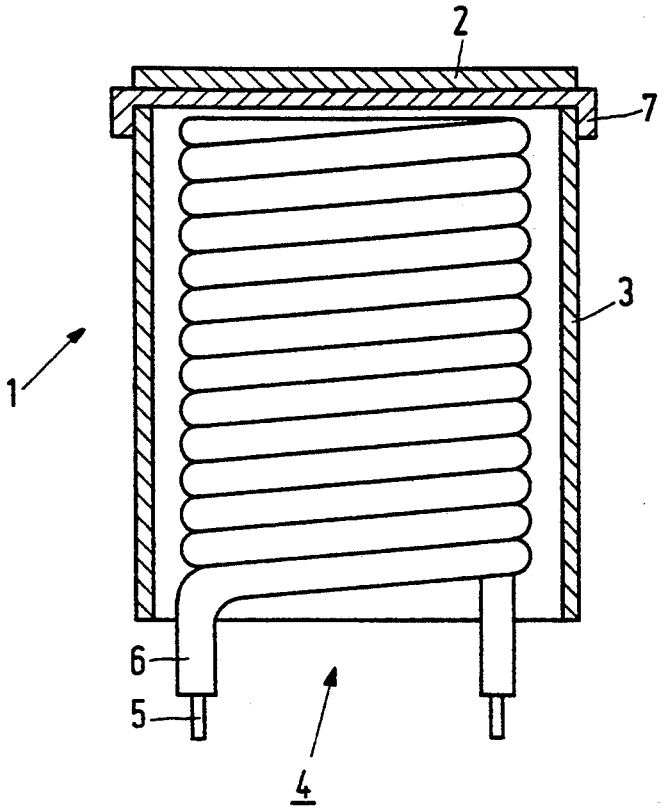
2
7
3
1
6
5
4

OXIDE CATHODE WITH RARE EARTH ADDITION

This is a continuation of application Ser. No. 07/781,541, filed Oct. 22, 1991 now abandoned.

BACKGROUND OF THE INVENTION

The invention relates to a cathode having a layer of electron-emissive material comprising alkaline earth material oxides, which oxides include at least barium oxide, and a rare earth metal, the layer being coated on a supporting body substantially comprising nickel.

The invention also relates to a method of manufacturing such a cathode, and to an electron beam tube provided with such a cathode.

The emission of such cathodes is based on the release of barium from barium oxide. In addition to the barium oxide, the electron-emissive material usually comprises strontium oxide and sometimes calcium oxide.

The actual emission is mainly ensured by small areas (so-called "sites") having the lowest effective electron work function, which sites are spread over the electron-emissive material. In practice, sites having a slightly higher work function will hardly contribute to the electron current generated by the cathode.

For a high effective electron emission it is therefore favourable to choose the number of sites having a minimal work function and the distribution of the sites over the emissive layer as optimally as possible.

In U.S. Pat. No. 4,797,593, improved electron emission properties are obtained by the addition of certain rare earth metals in amounts of at least 0.05% by weight.

OBJECTS AND SUMMARY OF THE INVENTION

It is one of the objects of the invention to realize such an optimum distribution in a cathode of the type mentioned in the opening paragraph with minimal additions of rare earth metals. It is another object of the invention to provide such a cathode which can withstand various manufacturing steps to which it is subjected while being incorporated into an electron tube, and which has a long lifetime.

A cathode according to the invention is therefore characterized in that the number of rare earth metal atoms in the electron-emissive material as a fraction of the number of alkaline earth metal atoms is 10–500 ppm, and in that the rare earth metal atoms are distributed substantially uniformly over at least the upper part of the layer of emissive material.

In a preferred embodiment of the invention, the layer of electron-emissive material is obtained by decomposition of a co-precipitated alkaline earth metal-rare earth metal compound.

In this respect, it is to be noted that rare earth metals are not only understood to mean the metals of the lanthanides but also the metals yttrium and scandium. In this connection, "distributed substantially uniformly" is understood to mean that each one of the separate particles of alkaline earth metal oxides in the layer of emissive material comprises rare earth metal atoms.

It is further to be noted that the provision of, for example, cerium in an emissive layer by means of co-precipitation is known per se from Japanese Patent Publication 74/12758. However, much larger quantities are concerned than in the present invention, viz. quantities within the range mentioned in U.S. Pat. No. 4,797,593.

A carbonate is preferably used for the alkaline earth metal-rare earth metal compound, but, for example, oxalates or formiates are alternatively possible.

The invention is based, inter alia, on the recognition that the uniform distribution of the rare earth metals leads to a uniform distribution of the number of emission sites. It is found that better cathode properties (higher emission, longer lifetime, etc.) are obtained when using small quantities of yttrium, scandium or one of the lanthanides than in cathodes without additions. Notably, additions of yttrium and europium yield good results.

Said lifetime improvement may be manifest in a less rapid decrease of the emission, but may also become manifest in a less rapid decrease of other properties which are important for the lifetime, such as, for example, the cut-off voltage. A cathode according to the invention may have a decrease of emission which is comparable to that of a cathode with 2.5% by weight of $Y_2O_3$ in the emissive layer in accordance with U.S. Pat. No. 4,797,593, it may have other lifetime properties which are so much better that it is to be preferred for use in an electron tube.

A method of manufacturing a cathode according to the invention is characterized in that a mixture of rare earth metal/alkaline earth metal compounds is provided on the supporting body, in which the number of rare earth metal atoms as a fraction of the number of alkaline earth metal atoms is 10–500 ppm.

BRIEF DESCRIPTION OF THE DRAWINGS

The invention will now be described in greater detail with reference to an embodiment and the drawing in which the sole FIGURE is a diagrammatic cross-sectional view of a cathode according to the invention.

DESCRIPTION OF THE PREFERRED EMBODIMENTS

The cathode 1 in the figure has a cylindrical nichrome cathode shaft 3 provided with a cap 7. The cap 7 substantially comprises nickel and may comprise reducing means such as, for example, silicon, magnesium, manganese, aluminium or tungsten. The cathode shaft 3 accommodates a helical filament 4 which comprises a metal helically wound core 5 and an electrically insulating aluminium oxide layer 6.

An approximately 70 μm thick layer of emissive material 2 is present on the cap 7, which layer comprises, for example, a mixture of barium oxide, strontium oxide and a rare earth metal obtained by providing and subsequently decomposing a co-precipitated barium-strontium-rare earth carbonate, or a mixture of barium oxide, strontium oxide, calcium oxide and a rare earth oxide.

EXAMPLE

A carbonate comprising 60 ppm of yttrium (as a fraction of the number of alkaline earth metal atoms) was obtained by dissolving 20.1 kg of barium nitrate and 16.5 kg of strontium nitrate in 160 ml of water, mixing together with 16.4 ml of a yttrium nitrate solution having a concentration of 50 mg of yttrium/liter, and heating this mixture to 88° C. An aqueous solution comprising 18 kg of sodium carbonate was subsequently added to the first solution at a rate of 1.1 liter/minute so that a completely co-precipitated barium-strontium-yttrium carbonate was obtained. The carbonate thus obtained was subsequently filtered, washed and dried.

A suspension was obtained by adding 2 liters of a binder solution (diethyl carbonate to which a small quantity of binder material (cellulose nitrate) is added) to 1.1 kg of the co-precipitated carbonate.

Similarly, a suspension was prepared using the above procedure containing 300 ppm of europium instead of 60 ppm of yttrium.

Cathodes of the type shown in the figure were prepared by coating the caps with the suspensions, and allowing the coatings to dry. The cathodes then were mounted in cathode ray tubes, and activated to decompose the carbonates to oxides.

After this standard mounting and activation of the cathodes in the tubes, the tubes were life tested by operating for 2000 hours at a filament voltage of 7 Volts, which is comparable to approximately 10,000 real operating hours. Before and after this life test, emission current measurements were performed at a filament voltage of 7 Volts after 30 seconds of conveying current at a cathode load of 2.2A/cm$^2$ (referred to as the $\Delta i_{k,30}$ measurement).

The decrease in emission current $\Delta i_{k,30}$ was 2% when yttrium was added and approximately 5% when europium was added, while the decrease was 24% without any additions. Moreover, the initial emission was found to be approximately 3% higher in the rare earth cathodes than in cathodes without any additions.

Also other properties such as, for example, the resistance to gases and thermal treatment of the tube were found to be considerably better.

The above-mentioned values of $\Delta i_k$ (decrease of emission current) are stated in Table I, as well as the decrease of the cut-off voltage ($\Delta V_k$) and the slump another measure of emission current decrease). The Table also states the values for a cathode made with 2.5% by weight of $Y_2O_3$ in accordance with U.S. Pat. No. 4,797,593, with 2.5% by weight of $Y_2O_3$ and for a cathode without any rare earth additions.

TABLE I

| Type of addition | $\Delta i_k$ | slump | $\Delta V_k$ |
|---|---|---|---|
| 60 ppm of Y (distributed uniformly) | 2% | 1.3% | 4.2% |
| 300 ppm of Eu (distributed uniformly) | 5% | 2% | 7.8% |
| 2.5% by weight of $Y_2O_3$ | 4% | 2% | 5% |
| No addition | 24% | 6.2% | 4.4% |

It is apparent from Table I that in all respects the cathode with 60 ppm of Y atoms has better lifetime properties than the cathode with 2.5% by weight of $Y_2O_3$ and is by far better than a cathode without additions. Although the cathode with 300 ppm of Eu has a slightly poorer lifetime behaviour than the Y samples, it has all the advantages of a better resistance to processing and less use of rare earth metals.

Similar lifetime tests as described hereinbefore were performed in other types of cathode ray tubes with cathodes in accordance with the invention in which 10 ppm of Eu, 60 ppm of Eu, 20 ppm of Y, 60 ppm of Y and 500 ppm of Y had been added to the emissive layer. The results are shown in Table II.

TABLE II

| Type of addition | $\Delta i_k$ | slump | $\Delta V_k$ |
|---|---|---|---|
| 10 ppm of Eu | 13.6% | 6.4% | 2.5% |
| 20 ppm of Y | 10.4% | 3.9% | 1.6% |
| 60 ppm of Eu | 4.2% | 2.6% | 4% |
| 60 ppm of Y | 7.9% | 1.9% | 3.6% |
| 500 ppm of Y | 8.2% | 4.6% | 5.4% |
| No addition | 30% | 15% | 3.2% |

It is apparent from Table II that for small quantities (10–20 ppm) of rare earth metal atoms, the emission decreases to a greater extent than in a cathode with 60 ppm of Y, but notably $\Delta V_k$ is much lower (under identical circumstances). Similar remarks apply to the cathode with 500 ppm of Y as for the cathode with 300 ppm of Eu in Table 1.

In the latter series of tests, one cathode was also tested which had an emissive layer consisting of a 40 μm thick layer without additions while, and on top of it a 20 μm thick layer with 60 ppm of Y atoms uniformly distributed. The comparable values of $\Delta i_k$ slump and $\Delta V_k$ were 10%, 2% and 1.8%, respectively, so that also in this case notably the low decrease of the cut-off voltage leads to a long lifetime.

The invention is of course not limited to the embodiments shown, but several variations are possible. For example, the cathode may be designed in various manners (cylindrical, concave, convex, etc.) and there are various methods of providing the electron-emissive layer. For example, this layer with the uniform distribution of the rare earth metals can also be obtained by depositing Ba-Sr-carbonate particles in a solution comprising yttrium (for example, an acetyl acetate solution) and by subsequent drying, with yttrium being left on each particle. An emissive coating can then be formed with the powder thus obtained.

I claim:

1. A cathode comprising a supporting body substantially comprising nickel, and a layer of electron-emissive material provided on the body, the layer comprising barium and at least one rare earth metal, characterized in that the number of rare earth metal atoms provided by the at least one rare earth metal in the electron-emissive material, as a fraction of the number of barium atoms provided by the barium oxide in the electron-emissive material, is 10–500 ppm and in that the rare earth metal atoms are distributed substantially uniformly in each barium oxide particle present in at least the upper part of the layer of electron-emissive material.

2. A cathode comprising a supporting body substantially comprising nickel and a layer of electron-emissive material provided on the body, the layer comprising barium oxide, at least one oxide selected from the group consisting of strontium oxide and calcium oxide and at least one rare earth metal, characterized in that the number of rare earth metal atoms which are provided by the at least one rare earth metal in the electron-emissive material, as a fraction of the number of barium atoms and atoms selected from the group consisting of strontium and calcium atoms provided by the at least one oxide selected from the group consisting of strontium oxide and calcium oxide in the electron-emissive material, is 10–500 ppm and in that the rare earth metal atoms provided by the at least one rare earth metal are distributed substantially uniformly in each particle of barium oxide and the at least one oxide selected from the group consisting of calcium oxide and strontium oxide present in at least the upper part of the layer of electron-emissive material.

3. A cathode as claimed in claim 2, characterized in that the rare earth metal atoms are distributed substantially uniformly over the layer of emissive material.

4. A cathode as claimed in claim 3, characterized in that the rare earth metal is selected from the group consisting of europium and yttrium.

5. A cathode as claimed in claim 3, characterized in that the emissive layer comprises barium oxide and strontium oxide.

6. A cathode as claimed in claim 3, characterized in that the supporting body comprises reducing means.

7. A cathode as claimed in claim 3, characterized in that the electron-emissive layer is obtained by the decomposition of a co-precipitated alkaline-earth rare-earth metal compound containing barium and at least one member selected from the group consisting of strontium and calcium compounds.

8. A cathode as claimed in claim 2, characterized in that the supporting body comprises reducing means.

9. A cathode as claimed in claim 2, characterized in that the rare earth metal is selected from the group consisting of europium and yttrium.

10. A cathode as claimed in claim 9, characterized in that the supporting body comprises reducing means.

11. A cathode as claimed in claim 2, characterized in that the electron-emissive layer is obtained by the decomposition of a co-precipitated alkaline-earth rare-earth metal compound containing barium.

12. A cathode as claimed in claim 11, characterized in that the co-precipitated compound is a carbonate.

13. A cathode as claimed in claim 12, characterized in that the rare earth metal is selected from the group consisting of europium and yttrium.

14. A cathode as claimed in claim 12, characterized in that the co-precipitated compound comprises barium oxide and strontium oxide.

15. A cathode as claimed in claim 12, characterized in that the supporting body comprises reducing means.

16. A cathode as claimed in claim 11 characterized in that the layer of electron emissive material comprises barium oxide and strontium oxide.

17. A cathode as claimed in claim 16, characterized in that the supporting body comprises reducing means.

18. A cathode comprising a supporting body substantially comprising nickel and a layer of electron-emissive material provided on the body, the layer comprising alkaline earth metal oxide, the alkaline earth metal oxide containing at least barium oxide and a rare earth metal, characterized in that the rare earth metal is present in such a concentration that the number of rare earth metal atoms provided by said rare earth metal in the electron-emissive material, as a fraction of the number of alkaline earth metal atoms in the electron-emissive material is 10–500 ppm and in that at least alkaline earth metal oxide particles present in the upper part of the layer of electron-emissive material comprise rare earth metal atoms whereby the rare earth metal atoms are distributed substantially uniformly.

* * * * *